US011195651B2

(12) United States Patent
Kojima et al.

(10) Patent No.: US 11,195,651 B2
(45) Date of Patent: Dec. 7, 2021

(54) INDUCTANCE ELEMENT

(71) Applicant: Alps Alpine Co., Ltd., Tokyo (JP)

(72) Inventors: Akinori Kojima, Niigata-ken (JP); Seisaku Imai, Niigata-ken (JP); Akira Sato, Niigata-ken (JP); Keiichiro Sato, Niigata-ken (JP)

(73) Assignee: Alps Alpine Co., Ltd., Tokyo (JP)

( * ) Notice: Subject to any disclaimer, the term of this patent is extended or adjusted under 35 U.S.C. 154(b) by 450 days.

(21) Appl. No.: 16/379,406

(22) Filed: Apr. 9, 2019

(65) Prior Publication Data

US 2019/0244745 A1 Aug. 8, 2019

Related U.S. Application Data

(63) Continuation of application No. PCT/JP2017/039152, filed on Oct. 30, 2017.

(30) Foreign Application Priority Data

Nov. 8, 2016 (JP) ..... JP2016217992

(51) Int. Cl.
*H01F 17/04* (2006.01)
*H01F 27/28* (2006.01)
(Continued)

(52) U.S. Cl.
CPC ..... *H01F 27/2823* (2013.01); *H01F 17/04* (2013.01); *H01F 27/255* (2013.01);
(Continued)

(58) Field of Classification Search
USPC ..... 336/221, 233
See application file for complete search history.

(56) References Cited

U.S. PATENT DOCUMENTS

2002/0158739 A1 10/2002 Shibata et al.
2016/0035476 A1* 2/2016 Mimura ..... H01F 17/0006 336/199
(Continued)

FOREIGN PATENT DOCUMENTS

JP 2002-184616 6/2002
JP 2002-324714 11/2002
(Continued)

OTHER PUBLICATIONS

International Search Report from International Application No. PCT/JP2017/039152 dated Dec. 12, 2017.

*Primary Examiner* — Ronald Hinson
(74) *Attorney, Agent, or Firm* — Beyer Law Group LLP

(57) ABSTRACT

An inductance element includes a magnetic core and a coil having a portion embedded in the magnetic core. This portion includes a wound portion formed by winging a wire-shaped coil material including a wire-shaped conductive material and an insulating coating. The insulating coating includes a thin-walled portion reduced in thickness. A biting ratio R is defined by formula: R=ds/B, which is from 0.4 to 0.85 inclusive, where B is the average thickness of inter-coil insulating coatings, and ds is an upper biting limit obtained by measuring a biting depth, approximating a frequency distribution of the results by a normal distribution, and computing, as the upper biting limit, the sum of the mean da of the normal distribution and the product of 3.99 and the standard deviation σ. The biting depth is obtained by subtracting, from the average thickness B, the thickness of the thin-walled portion.

8 Claims, 11 Drawing Sheets

(51) Int. Cl.
*H01F 27/255* (2006.01)
*H01F 27/32* (2006.01)

(52) U.S. Cl.
CPC ..... *H01F 27/2852* (2013.01); *H01F 27/323* (2013.01); *H01F 2017/046* (2013.01); *H01F 2017/048* (2013.01)

(56) References Cited

U.S. PATENT DOCUMENTS

| | | | | |
|---|---|---|---|---|
| 2016/0064136 | A1 | 3/2016 | Ogawa | |
| 2016/0086716 | A1* | 3/2016 | Choi | H01F 27/292 336/221 |
| 2017/0162319 | A1* | 6/2017 | Otani | H01C 7/18 |
| 2017/0169930 | A1* | 6/2017 | Kudo | H01F 17/04 |
| 2017/0178793 | A1* | 6/2017 | Muneuchi | H01F 27/292 |
| 2017/0200554 | A1* | 7/2017 | Kudo | H01F 27/255 |
| 2017/0221623 | A1* | 8/2017 | Kawarai | H01F 27/00 |
| 2018/0182539 | A1* | 6/2018 | Muneuchi | H01F 27/2828 |
| 2018/0247764 | A1* | 8/2018 | Muneuchi | B22F 1/02 |
| 2020/0335253 | A1* | 10/2020 | Yeo | H01F 27/292 |

FOREIGN PATENT DOCUMENTS

| | | |
|---|---|---|
| JP | 2003-272922 | 9/2003 |
| JP | 2004-253233 | 9/2004 |
| JP | 2006-339525 | 12/2006 |
| JP | 2010-272604 | 12/2010 |
| JP | 3181451 U | 1/2013 |
| JP | 2014-175531 | 9/2014 |
| JP | 2015-115341 | 6/2015 |
| JP | 2015-204337 | 11/2015 |
| JP | 2016-51899 | 4/2016 |
| JP | 2016-76559 | 5/2016 |

* cited by examiner

INDUCTANCE ELEMENT

CLAIM OF PRIORITY

This application is a Continuation of International Application No. PCT/JP2017/039152 filed on Oct. 30, 2017, which claims benefit of Japanese Patent Application No. 2016-217992 filed on Nov. 8, 2016. The entire contents of each application noted above are hereby incorporated by reference.

BACKGROUND OF THE INVENTION

1. Field of the Invention

The present invention relates to an inductance element including a magnetic core and a coil embedded in the magnetic core.

2. Description of the Related Art

Japanese Unexamined Patent Application Publication No. 2002-324714 discloses a coil-embedded dust core including: a compact formed from ferromagnetic metal particles coated with an insulating material; and a coil embedded in the compact and formed from a flat, insulation-coated conductor wound into a coil shape. It is stated that the coil-embedded dust core is produced by subjecting the coil and a powder mixture of a lubricant and an insulation-treated ferromagnetic powder for the dust core to compression molding (FIGS. 9 to 11 in Japanese Unexamined Patent Application Publication No. 2002-324714).

Inductance elements including the coil-embedded dust core disclosed in Japanese Unexamined Patent Application Publication No. 2002-324714 are widely used as components for driving displays of portable communication terminals such as smartphones. There is a continuous need for thinner and smaller portable communication terminals, and there is also a continuous need for display units having improved performance such as improved maximum display brightness. In view of the foregoing needs, inductance elements are required to be reduced in size (including height) and improved in withstand voltage (to address increased driving voltage) while appropriate basic characteristics (such as L/DCR) of the elements are maintained, but these requirements are in a trade-off relation.

SUMMARY OF THE INVENTION

In view of the foregoing circumstances, the present invention provides an inductance element that can maintain an appropriate withstand voltage and appropriate element functions even when the inductance element is reduced in size. The present invention also provides a method for producing the inductance element.

One aspect of the present invention provided to solve the foregoing problem provides an inductance element including: a magnetic core that is a compact containing a magnetic powder; and a coil having a portion embedded in the magnetic core, wherein the portion of the coil that is embedded in the magnetic core includes a wound portion formed by winging a wire-shaped coil material including a wire-shaped conductive material and an insulating coating that covers a surface of the conductive material, wherein the insulating coating on the wound portion has a portion located in a region capable of being in contact with the magnetic powder, the portion of the insulating coating including a thin-walled portion reduced in thickness due to contact with the magnetic powder, and wherein a biting ratio R defined by formula (I) below is from 0.4 to 0.85 inclusive:

$$R=ds/B \quad \text{(I)}$$

where B is the average thickness (unit: μm) of inter-coil insulating coatings, the inter-coil insulating coatings being portions of the insulating coating that are located between two adjacent portions of the conductive material in the wound portion, the average thickness being the arithmetic mean of measurement results obtained by measuring the thicknesses of the inter-coil insulating coatings at at least 100 points, and ds is an upper biting limit (unit: μm) obtained by measuring a biting depth d (unit: μm) at at least 15 points in the inductance element, approximating a frequency distribution of the results of the measurement by a normal distribution, and computing, as the upper biting limit, the sum ($da+3.99\sigma$) of the mean da of the normal distribution and the product of 3.99 and the standard deviation $\sigma$ of the normal distribution, the biting depth being a value obtained by subtracting, from the average thickness B of the inter-coil insulating coatings, the thickness of the thin-walled portion that is smaller than the average thickness B of the inter-coil insulating coatings.

In this inductance element, an appropriate reduction in thickness of part of the insulating coating on the wound portion of the coil is achieved (i.e., the insulating coating has thin-walled portions having an appropriate thickness). With this structure, even when the inductance element is reduced in thickness and height, a reduction in the basic characteristics of the inductance element, particularly a reduction in L/DCR, can be prevented while the insulating coating included in the coil used has a thickness enough to prevent an excessive reduction in withstand voltage.

In the above inductance element, the average thickness B of the inter-coil insulating coatings may be from 1 μm to 5 μm inclusive. When the average thickness B of the inter-coil insulating coatings is within the above range, the formation of pinholes in the insulating coating is prevented suitably, and the shape of the inductance element can be reduced in size and height.

In the above inductance element, at least part of the magnetic powder may be composed of an amorphous alloy material. Generally, the magnetic powder composed of the amorphous alloy material is hard and resists deformation caused by pressure applied from the outside or pressure due to thermal expansion during production of the inductance element. Therefore, the magnetic powder can easily bite into the insulating coating, and the thin-walled portions are easily formed.

In the above inductance element, the magnetic powder has a median diameter D50 of preferably from 1 μm to 15 μm inclusive from the viewpoint of the ease of formation of the thin-walled portions.

In the above inductance element, the insulating coating may contain a polyimide-based material. The inductance element may be produced by heating the wound portion of the coil embedded in the magnetic core and causing the magnetic powder to bite into the insulating coating by utilizing the difference between the thermal expansion coefficient of the wound portion and the thermal expansion coefficient of the magnetic core to thereby form the thin walled portions. In this case, when the insulating coating is formed of a material that deforms excessively under heating, the thickness of the thin-walled portions tends to be reduced excessively, and therefore the possibility of dielectric breakdown is high. Therefore, when the thin-walled portions are formed using the above method, it is preferable that the insulating coating contains a high-softening point material such as polyimide.

In the above inductance element, the conductive material may have a strip shape, and the wire-shaped coil material may be wound in the wound portion using an edgewise winding.

In the above inductance element, it is sometimes preferable that the thickness of the thin-walled portions is measured on the insulating coating on the wire-shaped coil material at an end of the wound portion in a direction along a winding center line.

The above inductance element may have a portion in which an embedded depth of the wire-shaped coil material into the magnetic core in a direction along a winding center line of the wound portion is 0.25 mm or less. To achieve a reduction in height of the inductance element while the basic characteristics are maintained, the embedded depth of the wire-shaped coil material in the above region tends to be small. However, as described above, in the inductance element according to the present invention, the withstand voltage and the basic characteristics (particularly L/DCR) can be appropriately maintained even when the inductance element is reduced in height. Therefore, the inductance element may have a portion with an embedded depth of 0.25 mm or less.

Another aspect of the present invention provides a method for producing the inductance element according to the present invention. The production method includes: a molding step of placing, in a mold, a raw material member for forming the magnetic core and the coil including the wound portion formed from the wire-shaped coil material including the insulating coating and the conductive material and subjecting the raw material member and the coil to compression molding to obtain a molded product in which the wound portion is embedded in the magnetic core; and a heat treatment step of heating the molded product to thermally expand the conductive material in the wound portion, the magnetic powder being pressed into the insulating coating on the wound portion to thereby form the thin-walled portion in which the insulating coating is reduced in thickness.

With the above production method, the inductance element having the thin-walled portion can be formed efficiently and stably. When the thermal treatment conditions in the heat treatment step are set appropriately, strain generated in the constituent materials (particularly, the magnetic powder) of the magnetic core in the molding step can be relaxed.

It is sometimes preferable that a pressurization direction in the molding step is a direction along a winding center line of the wound portion.

Preferably, a heating temperature in the heat treatment step is equal to or lower than two times the softening temperature of a material forming the insulating coating. In this case, the magnetic powder is prevented from excessively biting into the insulating coating in a stable manner in the heat treatment step.

DESCRIPTION OF THE PREFERRED EMBODIMENTS

Figure 2:
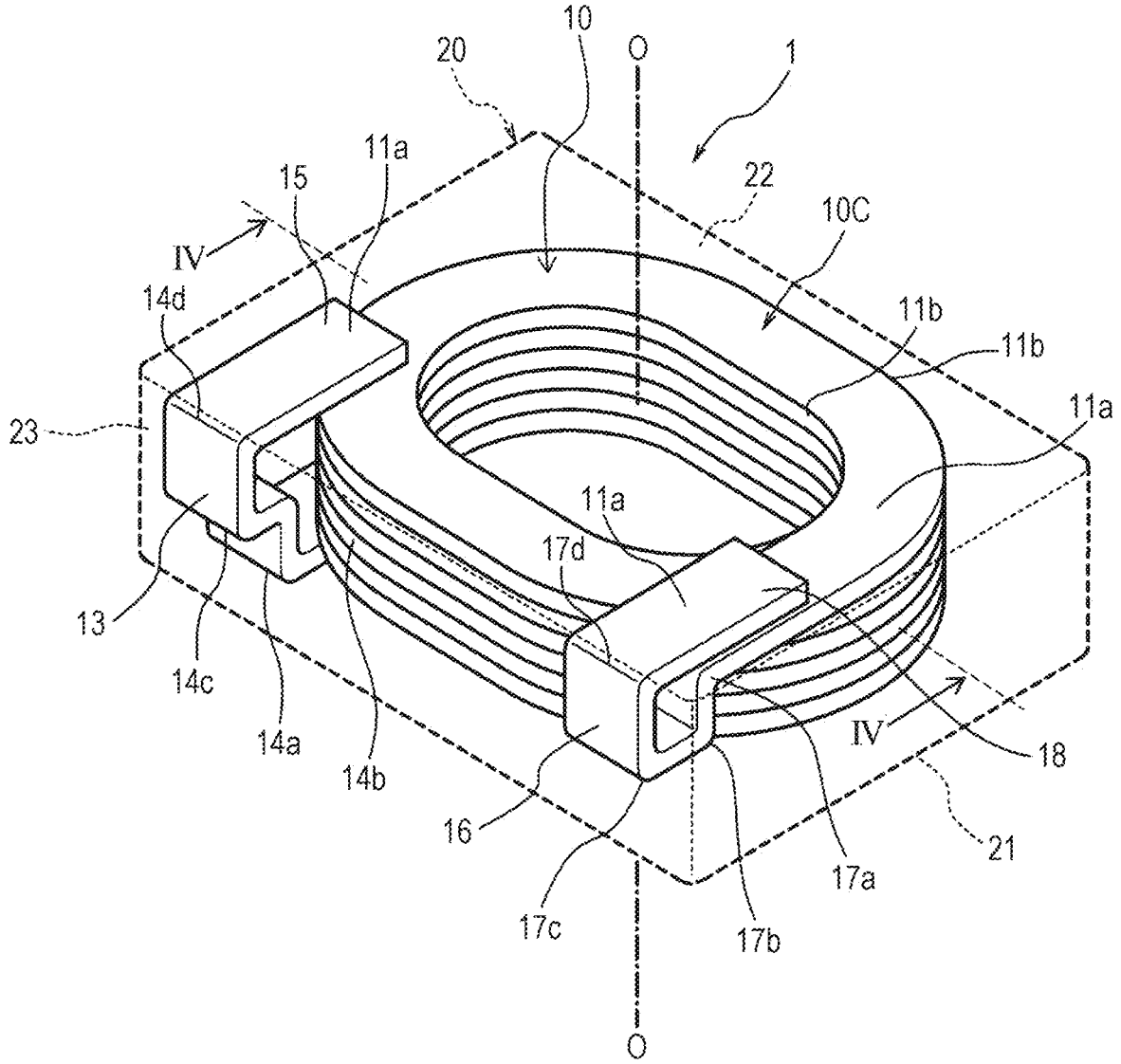
FIG. 2 is a perspective view showing the coil with bent terminal portions.

An inductance element 1 according to an embodiment of the present invention includes a powder compact serving as a magnetic core 20 and a coil 10 embedded in the magnetic core 20. In FIG. 2, the coil 10 embedded in the magnetic core 20 is indicated by solid lines, and the outer surface of the magnetic core 20 is indicated by dotted lines.

Figure 1:
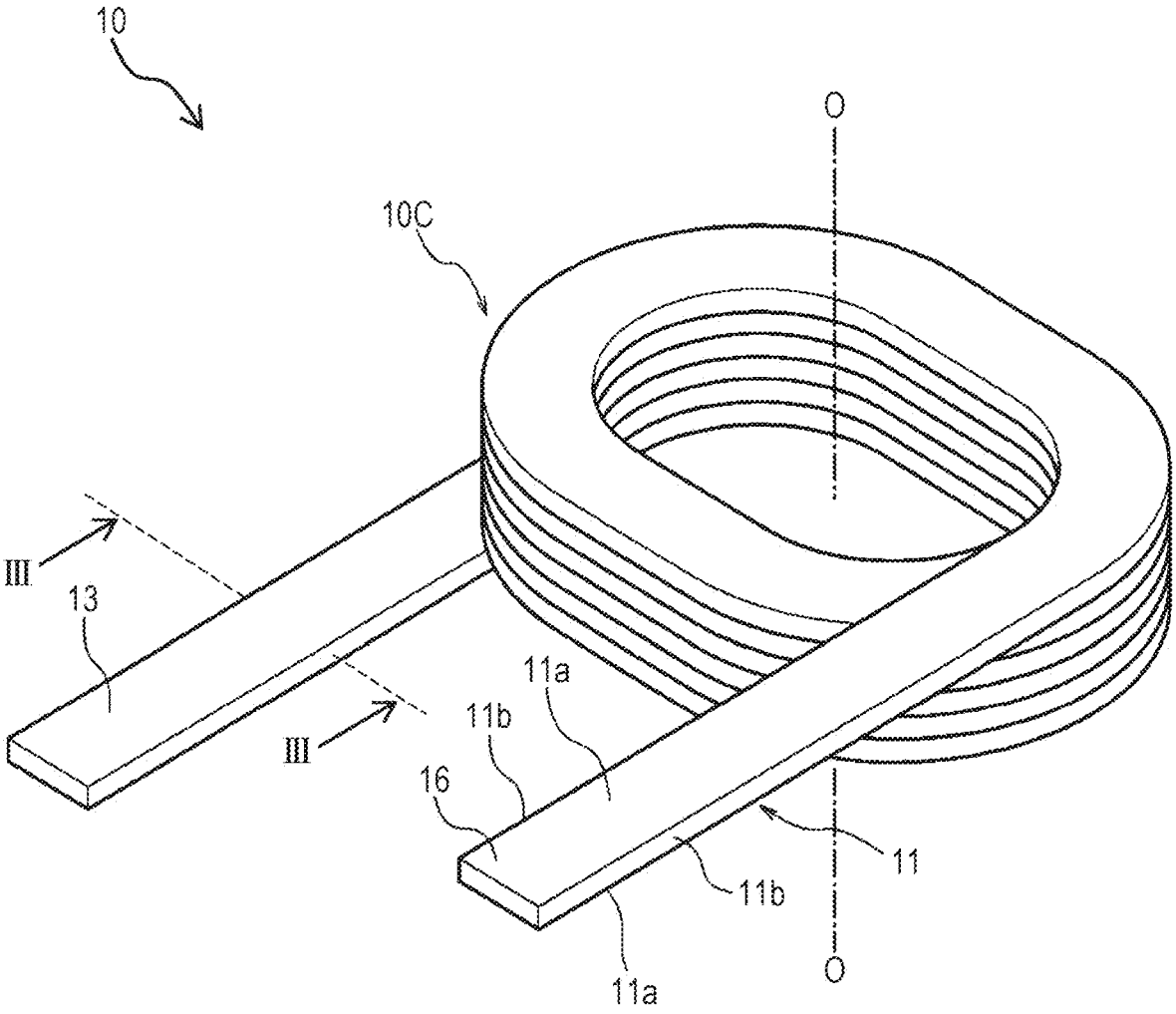
FIG. 1 is a perspective view showing a wound coil immediately after production, the coil being used for an inductance element according to an embodiment of the present invention.
Figure 3:
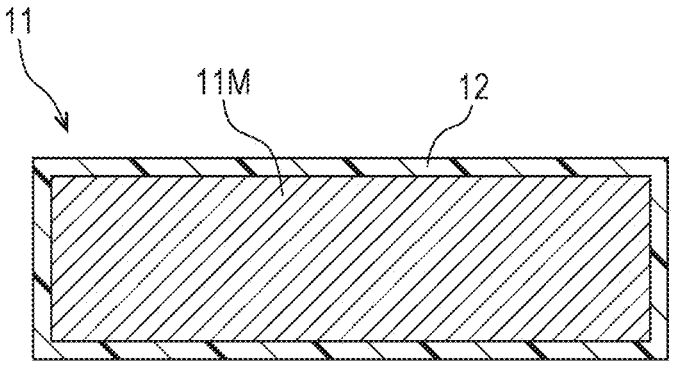
FIG. 3 is a cross-sectional view of the coil, the cross-sectional view taken along line in FIG. 1.

As shown in FIGS. 1 and 2, the coil 10 includes a wound portion 10C formed by winding a conductive strip 11 that is a wire-shaped coil material. The wound portion 10C is embedded in the magnetic core 20. As shown in FIGS. 1 and 2, the conductive strip 11 has plate surfaces 11*a*, 11*a* opposed to each other and side edge surfaces 11*b*, 11*b* opposed to each other. As shown in FIG. 3, the conductive strip 11 includes a wire-shaped conductive material 11M having a rectangular cross section and a coating resin layer 12 that is an insulating coating covering the surface of the conductive material 11M.

The conductive material 11M of the conductive strip 11 is formed of a conductive material such as copper, a copper alloy, aluminum, or an aluminum alloy, and the coating resin layer 12 is formed of, for example, a polyimide-based material, an epoxy-based material, or a polyamide-imide-based material. As described later, it is preferable from the viewpoint of producing the inductance element 1 according to the embodiment of the present invention efficiently that the material forming the coating resin layer 12 has high heat resistance and, particularly, has a high softening temperature. Therefore, a polyimide-based material having high heat resistance is suitable for the material forming the coating resin layer 12.

In FIGS. 1 and 2, a winding center line O of the coil 10 is shown. The coil 10 is wound such that the plate surfaces 11*a* of the conductive strip 11 are substantially perpendicular to the winding center line O and face each other along the winding center line O while the side edge surfaces 11*b* defining a thickness direction are parallel to the winding center line O. As shown in FIGS. 1 and 2, in the coil 10, the conductive strip 11 is wound into an elliptic shape. In FIGS. 1 and 2, the coil 10 has an elliptic shape but may have a perfect circular shape, and a person skilled in the art may select any suitable shape.

As showing in FIG. 1, in the elliptically-wound coil 10, a first end portion 13 and a second end portion 16 of the conductive strip 11 protrude from the coil 10. The end portions 13 and 16 are opposite ends portions of the conductive strip 11 that are not wound into the coil 10.

As shown in FIG. 2, the first end portion 13 is bent approximately 90° along a first fold line 14*a* in a valley fold direction, approximately 90° along a second fold line 14*b* in a mountain fold direction, and approximately 90° along a third fold line 14*c* and a fourth fold line 14*d* in the valley fold direction. The second end portion 16 is bent approximately 90° along a first fold line 17*a* in the mountain fold direction and approximately 90° along a second fold line 17*b*, a third fold line 17*c*, and a fourth fold line 17*d* in the valley fold direction.

A portion of the first end portion 13 that extends forward from the fourth fold line 14*d* is a first terminal portion 15, and a portion of the second end portion 16 that extends forward from the fourth fold line 17*d* is a second terminal portion 18.

When the inductance element 1 is placed on an unillustrated printed circuit board, the inductance element 1 is placed with the first terminal portion 15 and the second terminal portion 18 facing down. Therefore, the upward surface in FIG. 2 corresponds to a lower surface (back surface) of the inductance element 1 placed on the printed circuit board.

As shown in FIG. 2, the magnetic core 20, which is a powder compact, has a cuboidal shape having an upper surface 21, a lower surface (back surface) 22, and four side surfaces. As shown in FIG. 2, the outer surfaces of the first terminal portion 15 and the second terminal portion 18 formed in the first end portion 13 and the second end portion 16, respectively, of the conductive strip 11 that extend from the coil 10 are exposed at the lower surface 22 of the magnetic core 20. The outer surfaces of the first terminal portion 15 and the second terminal portion 18 are substantially flush with the lower surface 22 of the magnetic core 20.

As shown in FIG. 2, in the first end portion 13 of the conductive strip 11, a plate surface 11*a* of a portion located between the fold line 14*c* and the fold line 14*d* appears on a side surface 23 of the magnetic core 20. In the second end portion 16, a plate surface 11*a* of a portion located between the fold 17*c* and the fold 17*d* appears on the surface 23 of the magnetic core 20. These plate surfaces 11*a* are substantially flush with the side surface 23.

Figure 4:
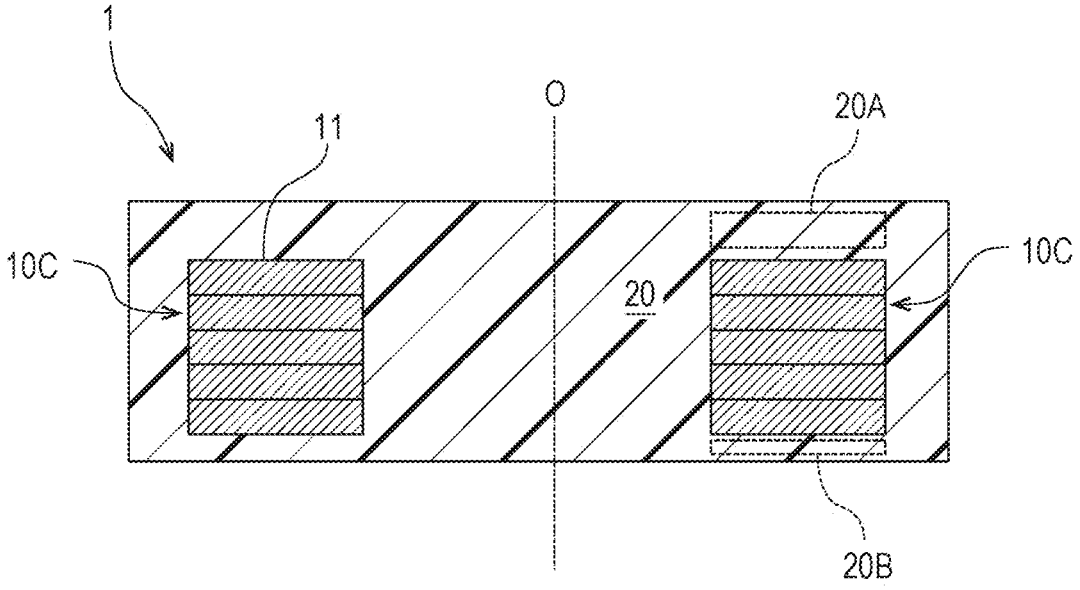
FIG. 4 is a cross-sectional view of the inductance element, the cross-sectional view being taken along line IV-IV in FIG. 2.
Figure 5:
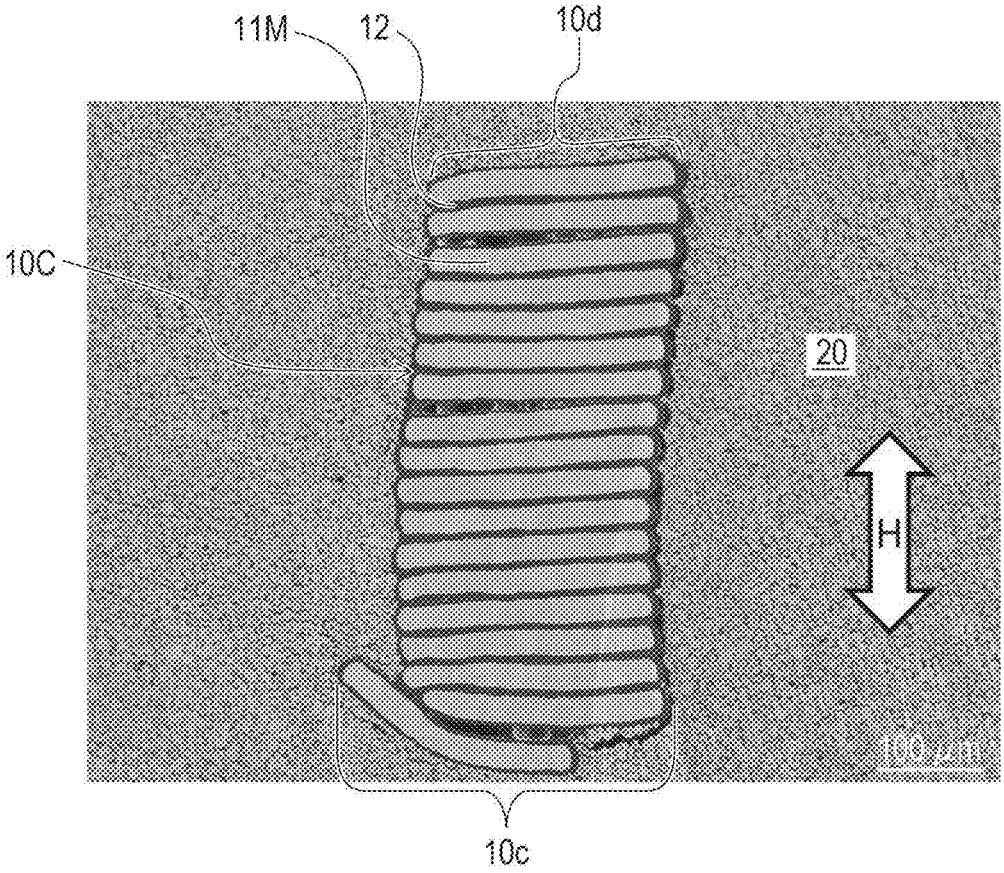
FIG. 5 is an observation image corresponding to a partial enlarged cross-sectional view obtained by enlarging part of FIG. 4.

FIG. 4 is a cross-sectional view of the inductance element that is taken along line IV-IV in FIG. 2. FIG. 5 is an observation image corresponding to a partial enlarged cross-sectional view obtained by enlarging part of FIG. 4.

As shown in FIG. 4, in the wound portion 10C, the conductive material 11M is wound so as to form portions stacked with the short sides of their rectangular cross sections aligned with each other. As shown in FIG. 5, the coating resin layer 12 is located between the stacked portions of the conductive material 11M so as to cover the stacked portions. In FIG. 5, a direction H is a direction extending along the winding center line O of the coil 10.

In recent years, there is an increasing need for a inductance element 1 reduced in size, particularly in height. One method for meeting the need is to reduce the thickness of the coating resin layer 12. In practice, the thickness of a conventional coating resin layer 12 is about 10 μm or more. However, recently, the thickness is reduced to 5 μm or less. Only from the viewpoint of achieving a reduction in the height of the inductance element 1, it is preferable to reduce the thickness of the coating resin layer 12. However, if the thickness is excessively small, the influence of variations in thickness is significant, and the withstand voltage is reduced significantly. Therefore, in practice, the lower limit of the thickness is about 1 μm.

The magnetic core 20 is located around the wound portion 10C. To achieve a reduction in height of the inductance element 1, the volumes of regions 20A, 20B (see FIG. 4) of the magnetic core 20 that are located at end portions along the winding center line O are reduced. In these regions, the density of magnetic flux generated by the coil 10 is particularly high. Therefore, when the volumes of these regions are small, the characteristics of the coil, particularly L/DCR, tend to be lowered.

As will be shown in Examples described later, when the thickness of the coating resin layer 12 is increased in order to increase the withstand voltage, L/DCR tends to decrease.

As described above, when the thickness of the coating resin layer 12 is simply reduced in order to reduce the height of the inductance element 1, the characteristics of the coil may deteriorate, and particularly the withstand voltage may be reduced. In particular, when the thickness of the coating resin layer 12 is less than 1 μm, variations in the thickness of the coating resin layer 12 increase. In this case, the conductive material 11M may not be fully covered with the coating resin layer 12, and it is highly possible that uncovered portions (such as pinholes) are formed. In this inductance element 1, the coil 10 has portions in which the conductive material 11M is exposed, so that the withstand voltage can be 0 V.

When the thickness of the coating resin layer 12 is increased to prevent a reduction in the withstand voltage, a reduction in L/DCR may occur. It is difficult to increase the L/DCR while the withstand voltage is maintain.

Figure 6:
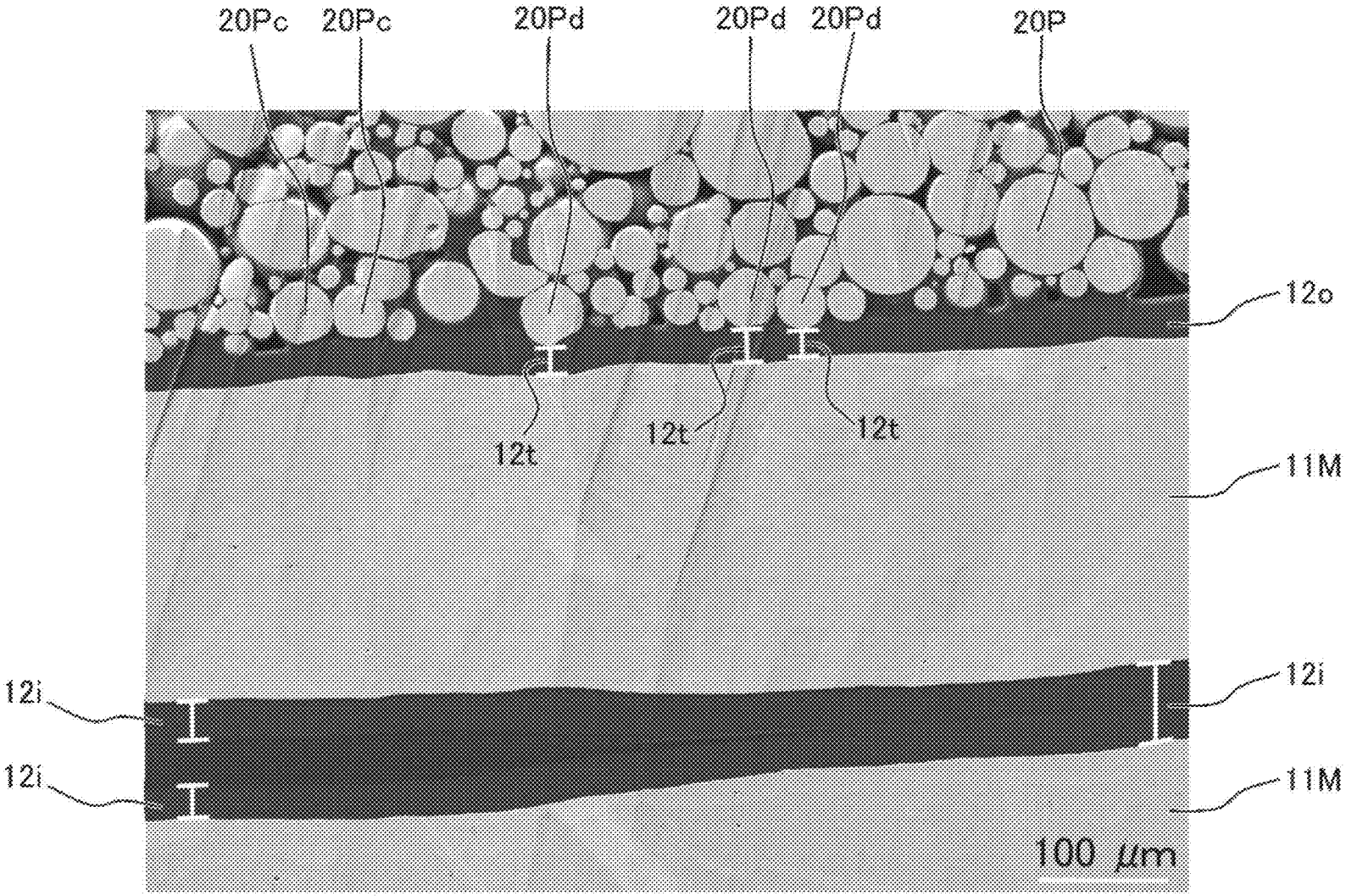
FIG. 6 is an enlarged observation image of a region including an end portion of a wound portion in a direction along the winding center of the wound portion.
Figure 7:
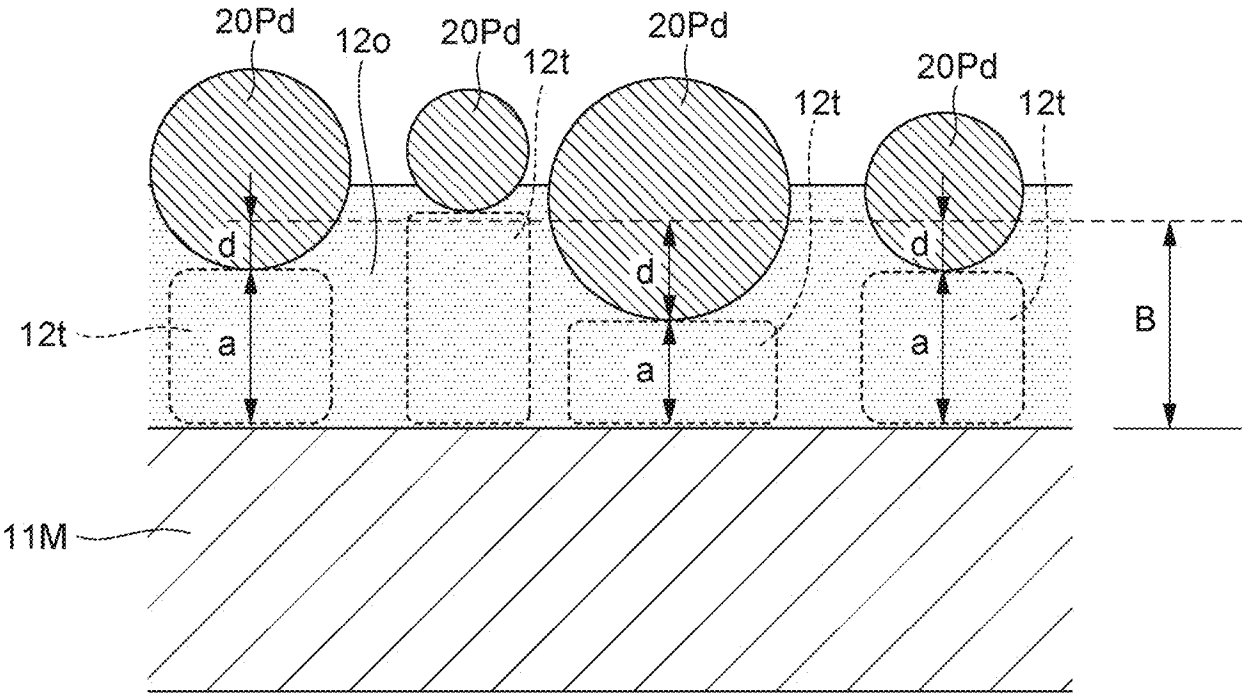
FIG. 7 is an illustration conceptually illustrating biting of magnetic powder at the end portion of the wound portion in the direction along the winding center line.

The inventors have conducted studies to solve the above problem and found that, by controlling the biting depth of magnetic powder into the coating resin layer 12 as described using FIGS. 6 and 7, the characteristics of the coil, particularly L/DCR, can be improved while the withstand voltage is maintained at a certain level or higher.

FIG. 6 is an enlarged observation image of a region including an end portion of the wound portion in a direction along the winding center line. FIG. 7 is an illustration conceptually illustrating biting of the magnetic powder at the end portion of the wound portion in the direction along the winding center line.

As shown in FIG. 6, in the end portion of the wound portion 10C in the direction along the winding center line O (the end portion may be hereinafter referred to also as a "winding axis end portion," winding axis end portions being denoted by numerals 10*c* and 10*d* in FIG. 5), a coating resin layer 12*o* located in a region (winding axis end portion) that can be in contact with the magnetic powder 20P (this coating resin layer 12*o* is hereinafter referred to as an "insulating coating end portion") has thin-walled portions having a reduced thickness caused by contact with the magnetic powder 20P. FIG. 6 is an enlarged view of the winding axis end portion denoted by the numeral 10*d* in FIG. 5 and shows magnetic powder particles 20Pc in contact with the insulating coating end portion 12*o* and magnetic powder particles 20Pd biting into the insulating coating end portion 12*o*. When the magnetic powder particles 20Pd bite into portions of the insulating coating end portion 12*o*, the thickness of these portions of the insulating coating end portion 12*o* is reduced, and thin-walled portions 12*t* are thereby formed. The thicknesses of the thin-walled portions 12*t* are smaller than the thicknesses of coating resin layers 12*i* located between adjacent portions of the conductive material 11M in the wound portion 10C (the coating resin layers 12*i* are hereinafter referred to as "inter-coil insulating coatings").

Although the reason is not clear, the presence of the thin-walled portions 12*t* improves the coil characteristics, particularly L/DCR, of the inductance element 1. This could be because a larger amount of the magnetic powder can be charged into the inductance element 1. When these thin-walled portions 12*t* are not formed, it is not expected to further improve L/DCR even though the thickness of the coating resin layer 12 in the wound portion 10C is set to a producible thickness (2 to 5 μm) in order to achieve a reduction in size and height of the inductance element 1. However, by providing the thin-walled portions 12*t* appropriately, the coil characteristics, e.g., L/DCR, can be further improved.

Specifically, when the biting ratio R set based on the average thickness B of the inter-coil insulating coatings 12*i* and the biting depth d defined below is set appropriately, a reduction in the withstand voltage and deterioration in the coil characteristics can be properly prevented even when the inductance element is reduced in size and height.

In the present specification, "the average thickness B of the inter-coil insulating coatings 12*i*" means the arithmetic average (unit: μm) of measurement results obtained by measuring the thicknesses of the inter-coil insulating coatings 12*i* at 100 points or more. Each inter-coil insulating coating 12*i* is an insulating film (coating resin layer 12) disposed between two adjacent portions of the conductive material 11M in the wound portion 10C. Generally, two inter-coil insulating coatings 12*i* are disposed between two adjacent portions of the conductive material 11M so as to be close to each other (see FIG. 6). When the thicknesses of these inter-coil insulating coatings 12*i* are measured, the thickness of each of these two inter-coil insulating coatings 12*i* is measured when these can be distinguished from each other. Inter-coil insulating coatings 12*i* to which this measurement method is applicable are shown in the lower left corner of FIG. 6. When the interface between two inter-coil insulating coatings 12*i* disposed close to each other cannot be substantially distinguished from each other because of, for example, fusion, the distance between two adjacent portions of the conductive material 11M with the inter-coil insulating coatings 12*i* adhering thereto is measured, and one half of the distance is used as the thicknesses of the inter-coil insulating coatings 12*i* at that position. In the lower right corner of FIG. 6, inter-coil insulating coatings 12*i* to which this measurement method should be used are shown.

In the present specification, the "biting depth d" means a value (unit: μm) obtained by subtracting, from the average thickness B of the inter-coil insulating coatings 12*i*, the thickness "a" of a thin-walled portion 12*t* thinner than the average thickness B of the inter-coil insulating coatings 12*i*.

In the present specification, "the upper biting limit ds" is defined as follows. The biting depth d in one inductance element is measured at least 15 points, and the frequency distribution of the measurement results obtained is approximated by a normal distribution. The sum (unit: μm) of the mean da (unit: μm) of the normal distribution and the product of 3.99 and the standard deviation σ (unit: μm) of the normal distribution (i.e., da+3.99σ) is used as the upper biting limit ds. In this case, the process capability index Cpk is 1.33. The upper biting limit ds is a substantial upper limit of the biting depth d that is statistically inferred. The number of measurement points at which the biting depth d is measured to determine the normal distribution is preferably 20 or more and more preferably 30 or more. The upper limit of the number of measurement points is not set. From the viewpoint of further increasing the accuracy of the upper biting limit ds, it is sufficient that the number of measurement points be about 100.

In the present specification, the "biting ratio R" is defined by the following formula (I) using the average thickness B of the inter-coil insulating coatings 12*i* and the upper biting limit ds:

$$R = ds/B \quad \text{(I)}$$

In the inductance element 1 according to the embodiment of the present invention, the biting ratio R is from 0.4 to 0.85 inclusive.

When the biting ratio R is 0.4 or more, deterioration in the coil characteristics, particularly a reduction in L/DCR, can be properly prevented. From the viewpoint of preventing the reduction in L/DCR more stably, it is sometimes preferable that the biting ratio R is 0.45 or more. When the biting ratio R is 0.85 or less, a reduction in the withstand voltage can be properly prevented. From the viewpoint of preventing the reduction in the withstand voltage more stably, it is sometimes preferable that the biting ratio R is 0.8 or less.

From the viewpoint of facilitating the control of the characteristics of the inductance element 1 appropriately using the biting ratio R, it is preferable that the components of the inductance element 1 satisfy the following conditions.

The average thickness B of the inter-coil insulating coatings 12*i* is preferably from 1 μm to 5 μm inclusive. When the average thickness B of the inter-coil insulating coatings 12*i* is 1 μm or more, a reduction in the withstand voltage of the inductance element 1 can be prevented more stably. From this point of view, it is sometimes preferable that the average thickness B of the inter-coil insulating coatings 12*i* is 1.5 μm or more and more preferably 2 μm or more.

Preferably, the magnetic powder 20P is composed at least partially of an amorphous alloy material. Generally, the amorphous alloy material is harder than crystalline alloy materials. With the amorphous alloy material, the thin-walled portions 12*t* are easily formed. From the viewpoint of forming the thin-walled portions 12*t* appropriately, it is sometimes preferable that the magnetic powder 20P contains the amorphous alloy material in an amount of 50% by mass or more. No limitation is imposed on the specific composition of the amorphous alloy material. Specific examples of the amorphous alloy material include Fe—Si—B-based alloys, Fe—P—C-based alloys, and Co—Fe—Si—B-based alloys. The amorphous alloy material may be composed of one material or a plurality of materials.

An Fe—P—C-based material is an example of the amorphous alloy material, and a specific example of the composition of the Fe—P—C-based material is an Fe-based amorphous alloy represented by a composition formula Fe100 at %-a-b-c-x-y-z-tNiaSnbCrcPxCyBzSit with 0 at %≤a≤10 at %, 0 at %≤b≤3 at %, 0 at %≤c≤6 at %, 6.8 at %≤x≤13 at %, 2.2 at %≤y≤13 at %, 0 at %≤z≤9 at %, and 0 at %≤t≤7 at %. In the above composition formula, Ni, Sn, Cr, B, and Si are optional additional elements.

Preferably, the median diameter D50 (a particle diameter at which the cumulative volume from the small diameter side in a volume-based particle size distribution is 50 vol %. The particle size distribution is typically determined by particle size distribution measurement using a laser diffraction-scattering method) of the magnetic powder is from 1 μm to 15 μm inclusive.

Preferably, the conductive material 11M has a strip shape, and the wire-shaped coil material 11 in the wound portion 10C is wound using an edgewise winding. With the edgewise winding, the density of the conductive material 11M in the wound portion 10C can be increased, and the coil characteristics can be easily improved. In this case, it is preferable that the thicknesses of the thin-walled portions 12*t* are measured on the insulating coating (insulating coating end portion 12*o*) on the wire-shaped coil material 11 at an end portion (a winding axis end portion 10*c* or 10*d*) in a direction along the winding center line O in the wound portion 10C. The winding axis end portions 10*c* and 10*d* are regions in which the magnetic flux tends to be high, and the thicknesses of the thin-walled portions 12*t* in these region can largely influence on the coil characteristics, particularly L/DCR.

When the above formula (I) is satisfied, a reduction in the withstand voltage and deterioration in the coil characteristics can be prevented properly even when the inductance element 1 is a low-height inductance element having a portion in which the embedded depth of the wire-shaped coil material 11 into the magnetic core 20 in the direction along the winding center line O of the wound portion 10 is 0.25 μm or less.

No limitation is imposed on the method for producing the inductance element 1 according to the embodiment of the present invention. When a production method described below is used, the inductance element 1 can be produced efficiently.

The method for producing the inductance element 1 according to the preceding embodiment of the present invention includes a molding step and a heat treatment step described below.

Figure 8:
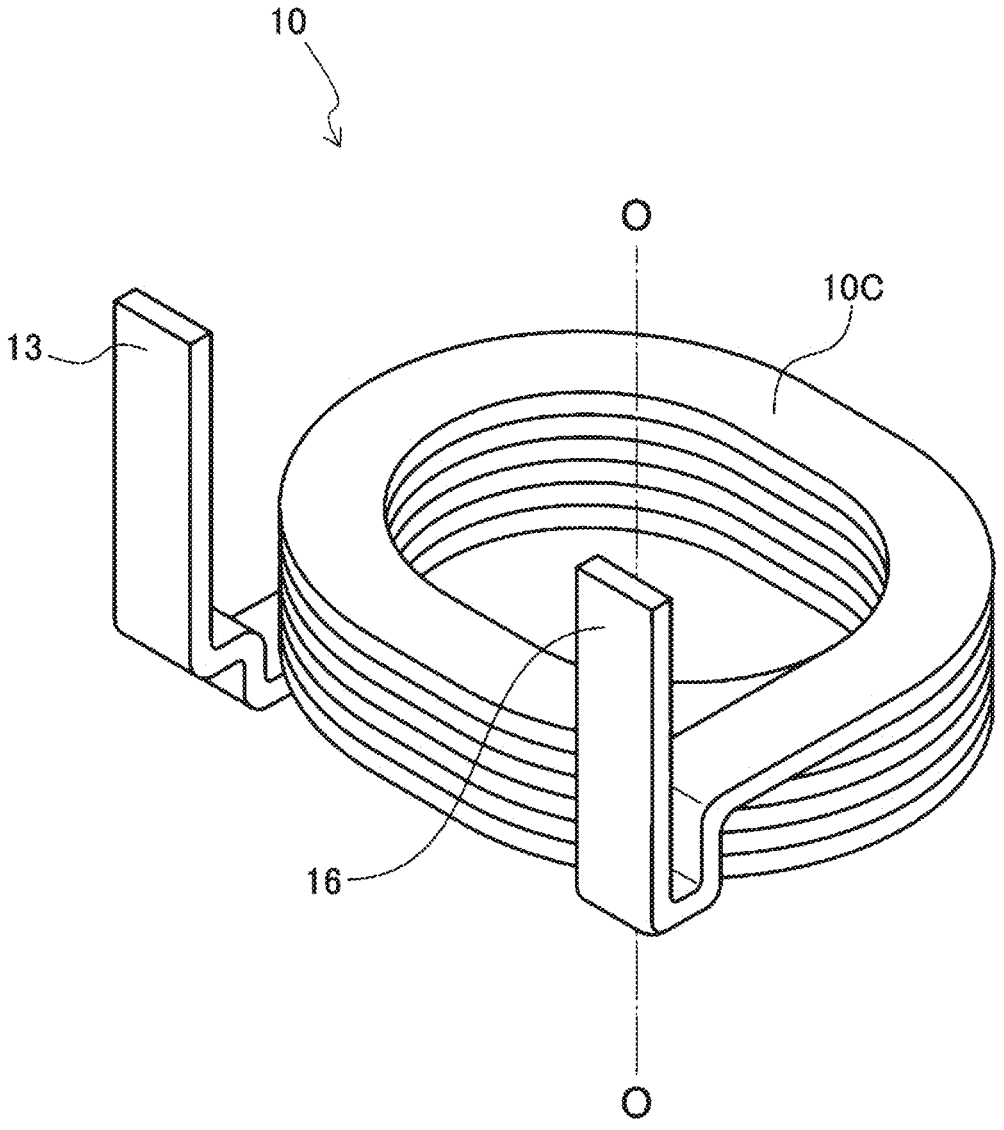
FIG. 8 is a perspective view conceptually illustrating the shape of a coil placed in a cavity of a mold in a molding step.
Figure 9:
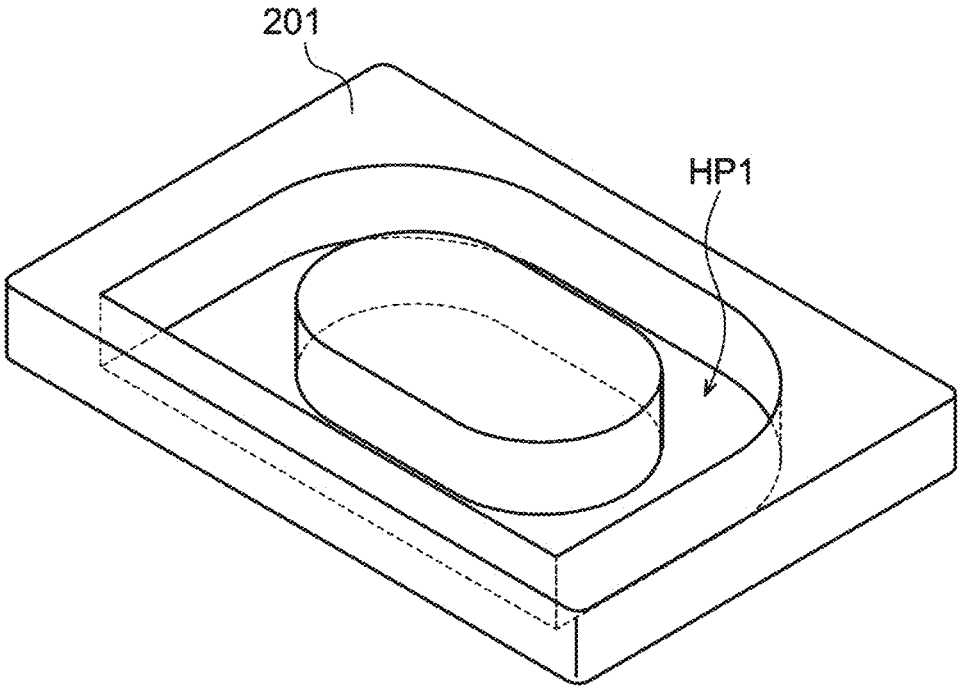
FIG. 9 is a perspective view conceptually illustrating the structure of a raw material member placed in one half of the mold in the molding step.
Figure 10:
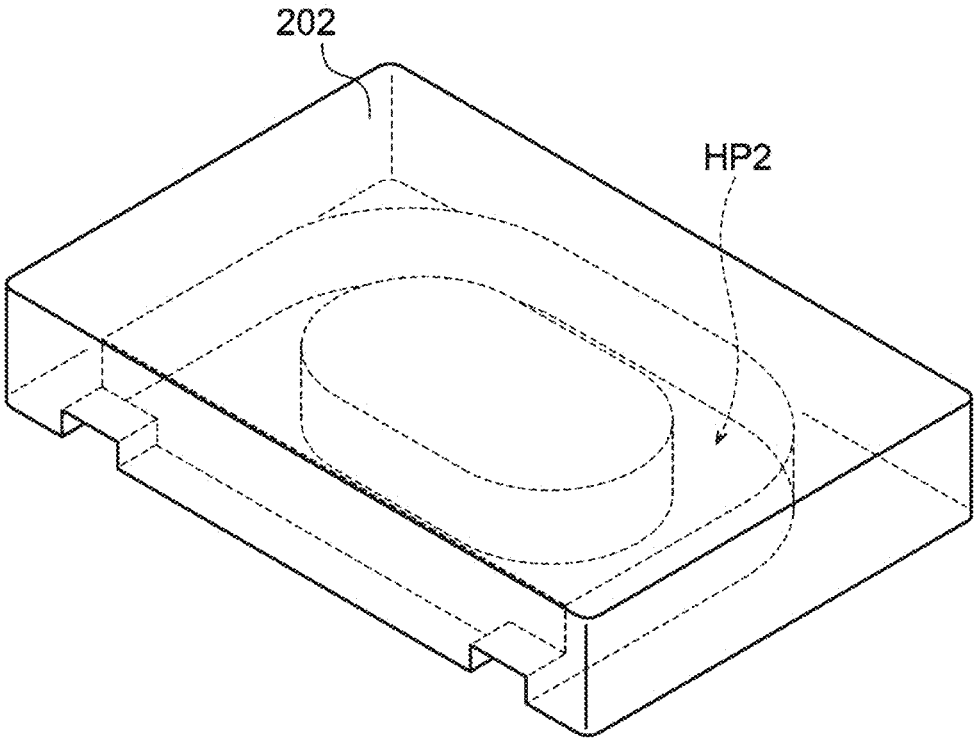
FIG. 10 is a perspective view conceptually illustrating the structure of a raw material member placed in the other half of the mold in the molding step.
Figure 11:
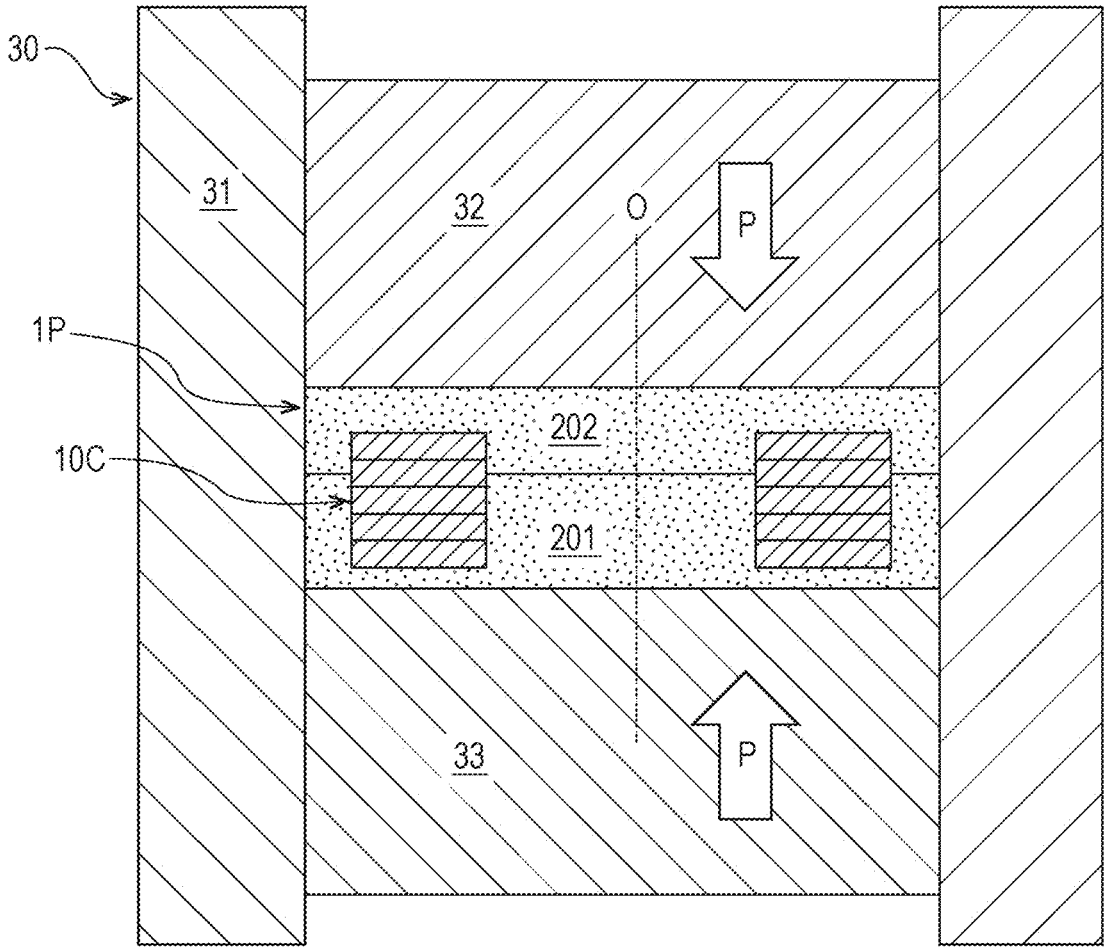
FIG. 11 is a cross-sectional view showing the molding step, conceptually illustrating the mold and members placed in the mold.

FIG. 8 is a perspective view conceptually illustrating the shape of the coil placed in a cavity of a mold in the molding step. FIG. 9 is a perspective view conceptually illustrating the structure of a raw material member placed in one half of the mold in the molding step. FIG. 10 is a perspective view conceptually illustrating a raw material member placed in the other half of the mold in the molding step. FIG. 11 is a cross-sectional view showing the molding step, conceptually illustrating the mold and members placed in the mold.

In the molding step, the raw material members for forming the magnetic core 20 and the coil 10 including the wound portion 10C formed by winding the wire-shaped coil material 11 including the insulating coating (the coating resin layer 12) and the conductive material 11M are placed in a mold 30 and subjected to compression molding. As shown in FIG. 11, the mold 30 includes a mold body 31, an upper mold 32, and a lower mold 33, and a cavity is defined by the mold body 31, the upper mold 32, and the lower mold 33. As shown in FIG. 8, the first end portion 13 and the second end portion 16 of the coil 10 are bent. First, a first raw material member 201 shown in FIG. 9 is placed in the cavity of the mold 30. Next, the coil 10 having the shape shown in FIG. 8 is placed in the cavity of the mold 30 such that the wound portion 10C is placed in a first hollow portion HP1 of the first raw material member 201. Next, a second raw material member 202 shown in FIG. 10 is placed in the cavity of the mold 30 such that the wound portion 10C is housed in a second hollow portion HP2.

When a member 1P composed of the first raw material member 201, the coil 10, and the second raw material member 202 is placed in the cavity of the mold 30, the upper mold 32 and the lower mold 33 are disposed close to each other in the direction along the winding center line O of the coil 10 as shown in FIG. 11. Therefore, a pressure is applied in a direction P along the winding center line O of the coil 10 to the member composed of the first raw material member 201, the coil 10, and the second raw material member 202, and the member is thereby subjected to molding. FIG. 11 shows the pressurized state. The first raw material member 201 and the second raw material member 202 are deformed and integrated by the pressure, and the magnetic core 20 is thereby formed. In this case, the magnetic powder 20P located around the wound portion 10C of the coil 10 moves so that adjacent portions of the coating resin layer 12 located on the surface of the wound portion 10C come close to each other. Therefore, in the coating resin layer 12 located on a surface portion of the wound portion 10C of the coil 10 that has a normal oriented in the pressurizing direction P, the magnetic powder 20P may bite into the coating resin layer 12 in this surface portion.

No limitation is imposed on the molding conditions. The pressure and heating temperature may be set in consideration of the amount of deformation and the materials (the magnetic powder 20P, resin components, etc.) contained in the first raw material member 201 and the second raw material member 202. When the pressure is applied under heating, the pressure applied may be set to a lower value. When the magnetic powder 20P contains a powder composed of an amorphous alloy, it is sometimes preferable to increase the pressure. In a non-limiting example of the pressure, the pressure is 0.01 GPa to 5 GPa. It may be preferable that the pressure is about 0.5 GPa to about 3 GPa when the magnetic powder 20P contains a powder composed of an amorphous alloy.

A molded product in which the wound portion 10C of the coil 10 is embedded in the magnetic core 20 is obtained through the molding step.

In the heat treatment step subsequent to the molding step, the molded product is heated to thermally expand the conductive material 11M in the wound portion 10C of the coil 10. From the viewpoint of appropriate thermal expansion, it is preferable that the thermal expansion coefficient of the conductive material 11M is larger than that of the magnetic core 20. From this point of view, the conductive material 11M is preferably a copper-based material or an aluminum-based material. When the conductive material 11M having a larger thermal expansion coefficient than the magnetic core 20 is expanded by heat, the coating resin layer 12 on the wound portion 10C of the coil 10 is pressed against the magnetic powder 20P. Part of the magnetic powder 20P thereby bites into the coating resin layer 12, and the thin-walled portions 12*t* with a reduced thickness are formed in the coating resin layer 12.

No limitation is imposed on the heat treatment conditions, so long as the thin-walled portions 12*t* are formed appropriately. In a non-limiting example of the heat treatment conditions, the maximum reachable temperature is 300° C. to 600° C., and the heating time is 10 minutes to 10 hours. Working strain in the molded product may be relaxed by the heat treatment in the heat treatment step.

As described above, in the heat treatment step, the formed product is heated. Therefore, when the coating resin layer 12 in the wound portion 10C of the coil 10 includes a fusible layer having a low softening point, the material forming the fusible layer (generally a resin material) is fused by heating and decomposed, so that the fusible layer does not function as the insulating coating for the conductive material 11M. When the inductance element 1 is produced by the production method according to the present embodiment of the invention, the coating resin layer 12 includes a layer of a material having a softening point high enough to allow the coating resin layer 12 to serve as the insulating coating even after the heat treatment step. Specific examples of the softening point of the material include 400° C. to 500° C., and specific examples of the high-softening point material include polyimide.

The exterior of the molded product subjected to the heat treatment step is optionally covered with a coating, and electrodes are formed by printing, plating, etc. The inductance element 1 according to the embodiment of the present invention is thereby obtained.

The above embodiments are described in order to facilitate understanding of the present invention and are not intended to limit the present invention. Therefore, the elements disclosed in the above embodiments involve all design changes and equivalents that fall within the technical scope of the present invention.

For example, in the wound portion 10C of the coil 10 included in the inductance element 1, the wire-shaped coil material 11 having a rectangular cross section is wound such that its short sides are disposed in the direction along the winding center line O, but this is not a limitation. The wire-shaped coil material 11 having a rectangular cross section may be wound such that its long sides are disposed in the direction along the winding center line O. Specific examples of such a winding method include a so-called a winding. The cross section of the wire-shaped coil material 11 may not be rectangular and may be square or circular.

EXAMPLES

The present invention will next be specifically described by way of Examples. However, the scope of the present invention is not limited to these Examples.

Example 1

The inductance element according to the preceding embodiment of the present invention was produced by the above-described method. The shape and the production conditions are as described below. A plurality of wire-shaped coil materials (including insulating coatings different in thickness) were used to produce different inductance elements.

Shape and Materials:

External shape of element: 2.5 mm×2.0 mm×1.0 mm (thickness)

Cross sectional shape of wire-shaped coil material: rectangle of 0.2 to 0.25 mm×0.02 to 0.03 mm Main constituent material of magnetic core: magnetic powder composed of Fe—P—C-based amorphous alloy material and having median diameter D50 of 5 to 8 μm Constituent material of insulating coating: polyimide-based material Constituent material of fusible layer: Nylon-based material Constituent material of conductive material: copper-based material Shape of wound portion: number of turns 16 to 18, total thickness 0.4 to 0.5 mm Molding step:

Temperature: room temperature (25° C.)

Pressure: 0.6 to 1.2 GPa

Heat treatment step:

Maximum reachable temperature: 350 to 500° C.

Heating time: 0.1 to 1 hour

For each of the 11 inductance elements obtained, the withstand voltage (unit: V) and L/DCR (unit: mH/Ω) were measured. The measurement results are shown in Table 1.

TABLE 1

| | Withstand voltage (V) | L/DCR (mH/Ω) | Thickness of inter-coil insulating coating B (μm) | Upper biting limit ds (μm) | Biting ratio R | Remarks |
|---|---|---|---|---|---|---|
| Example 1 | 0.86 | 0.0160 | 1.78 | 1.78 | 0.99 | Comparative Example |
| Example 2 | 43 | 0.0153 | 2.38 | 1.88 | 0.79 | Inventive Example |
| Example 3 | 85 | 0.0137 | 2.94 | 1.95 | 0.66 | Inventive Example |
| Example 4 | 110 | 0.0141 | 3.08 | 1.80 | 0.58 | Inventive Example |
| Example 5 | 170 | 0.0132 | 3.21 | 1.23 | 0.38 | Comparative Example |
| Example 6 | 74 | 0.0141 | 3.30 | 2.44 | 0.74 | Inventive Example |
| Example 7 | 162 | 0.0137 | 3.51 | 1.63 | 0.46 | Inventive Example |
| Example 8 | 138 | 0.0135 | 3.79 | 2.18 | 0.58 | Inventive Example |
| Example 9 | 169 | 0.0122 | 4.24 | 2.28 | 0.54 | Inventive Example |
| Example 10 | 160 | Not measured | 4.39 | 2.53 | 0.58 | Inventive Example |
| Example 11 | 178 | 0.0123 | 4.97 | 2.90 | 0.58 | Inventive Example |

For each of the inductance elements, their partial discharge inception voltage (PDIV) was measured using the PROGRAMABLE HF AC TESTER MODEL 11802 manufactured by Chroma, and the withstand voltage was converted from the measurement results. In each of the Examples, a plurality of samples of the wire-shaped coil material were prepared, and the partial discharge inception voltage (PDIV) of each sample was measured at two frequencies of 20 kHz and 180 kHz. The arithmetic average of the results was used as the partial discharge inception voltage Vr (unit: V) of the wire-shaped coil material.

A cross section of each sample of the wire-shaped coil material was observed, and the thickness of the insulating coating in the observation image was measured at at least 30 points. The frequency distribution of the results of the measurement of the thickness of the insulating coating was approximated by a normal distribution, and the average thickness dar of the insulating coating and the standard deviation σr were determined. A value obtained as dar−3σr was used as the thickness dtr (unit: μm) of the thinnest portion of the insulating coating.

The withstand voltage Vn per unit thickness (unit: V/μm) was determined from the following formula using the above-determined partial discharge inception voltage Vr of the wire-shaped coil material and the thickness dtr of the thinnest portion:

$$Vn=Vr/dtr$$

The withstand voltage Vn per unit thickness determined by the above method was 86 V/μm. For each of the Examples, the upper biting limit ds (unit: μm) was determined by a method described later (the values are shown in Table 1), and the value obtained as Vn×ds was used as the withstand voltage (unit: V) in the Example.

L/DCR was determined as follows. The inductance L (unit: μH) was measured using the impedance analyzer 4294A manufactured by Agilent Technologies, and the DC resistance (unit: mΩ) was measured using the "milliohm HiTESTER 3540" manufactured by HIOKI E. E. CORPORATION. The measured L and DCR were used to compute L/DCR (unit: mH/Ω).

Each of the inductance elements produced in the Examples was cut along a plane including the winding center line, and the obtained cross section was observed under a scanning electron microscope.

The images shown in FIGS. 5 and 6 are cross-sectional images of the inductance element according to Example 4. In these cross-sectional images, 225 points were arbitrarily selected in the inter-coil insulating coatings 12*i* located between 18 layer portions of the conductive material 11M, and the thicknesses of the inter-coil insulating coatings 12*i* were measured at these points. The arithmetic mean of the measurements was determined and used as the average thickness B of the inter-coil insulating coatings 12*i* (unit: μm) (see Table 2).

66 points were arbitrarily selected in the insulating coating (the coating resin layer 12*o*) located on the surfaces 10*c* and 10*d* of the wound portion 10C that were oriented in the direction along the winding center line O, and the thickness of the insulating coating (unit: μm) was measured at these points. 32 thin-walled portions having a thickness equal to or less than the average thickness B of the inter-coil insulating coatings 12*i* were selected from the measurement results. Each of the thicknesses of the selected thin-walled portions was subtracted from the average thickness B of the inter-coil insulating coatings 12*i* to determine the biting depth d (unit: μm). The biting depths d at the 32 points are shown in Table 2.

TABLE 2

| | Thickness of thin-walled portion 12t (μm) | Average thickness of inter-coil insulating coating (μm) | Biting depth d (μm) |
|---|---|---|---|
| 1 | 2.761 | 3.080 | 0.319 |
| 2 | 2.889 | | 0.191 |
| 3 | 2.795 | | 0.285 |
| 4 | 2.993 | | 0.087 |
| 5 | 2.507 | | 0.573 |
| 6 | 1.826 | | 1.254 |
| 7 | 2.421 | | 0.659 |
| 8 | 2.545 | | 0.535 |
| 9 | 2.543 | | 0.537 |
| 10 | 2.612 | | 0.468 |
| 11 | 2.476 | | 0.604 |
| 12 | 2.944 | | 0.136 |
| 13 | 2.345 | | 0.735 |
| 14 | 2.813 | | 0.267 |
| 15 | 2.559 | | 0.521 |
| 16 | 2.308 | | 0.772 |
| 17 | 2.509 | | 0.571 |
| 18 | 2.616 | | 0.464 |
| 19 | 3.067 | | 0.013 |
| 20 | 2.881 | | 0.199 |
| 21 | 2.854 | | 0.226 |
| 22 | 3.029 | | 0.051 |
| 23 | 2.981 | | 0.099 |
| 24 | 2.884 | | 0.196 |
| 25 | 2.249 | | 0.831 |
| 26 | 2.164 | | 0.916 |
| 26 | 2.912 | | 0.168 |
| 27 | 2.449 | | 0.631 |
| 28 | 2.532 | | 0.548 |
| 29 | 3.029 | | 0.051 |
| 30 | 2.902 | | 0.178 |
| 31 | 1.735 | | 1.345 |
| 31 | 2.263 | | 0.817 |
| 32 | 2.372 | | 0.708 |

The frequency distribution of the results of the measurement of the biting depth d was approximated by a normal distribution. In the normal distribution, the mean da was 0.469 μm, and the standard deviation σ was 0.334 μm. Therefore, the upper biting limit ds (=da+3.99σ) at which the process capability index Cpk was 1.33 was 1.80 μm, and the biting ratio R (=ds/B) was 0.59 (see Table 1).

Figure 12:
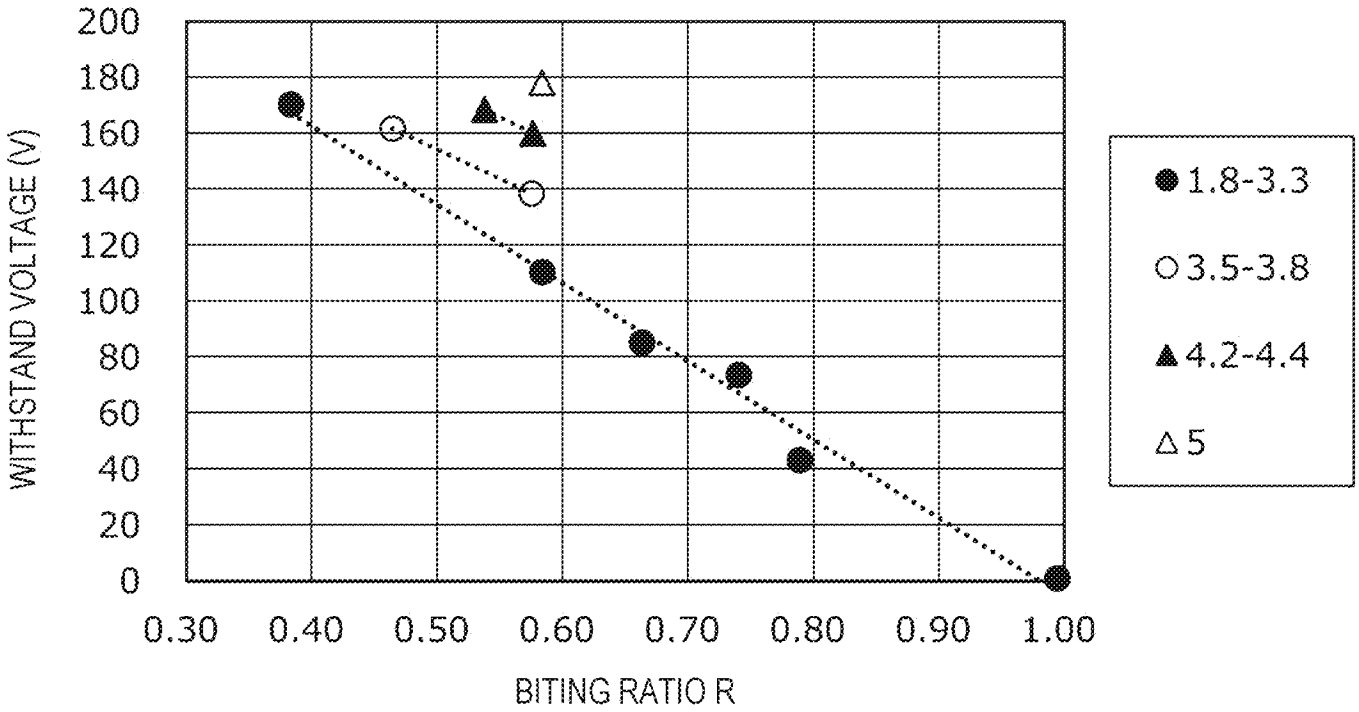
FIG. 12 is a graph showing the relation between the withstand voltage (unit: V) of coils and a biting ratio R.
Figure 13:
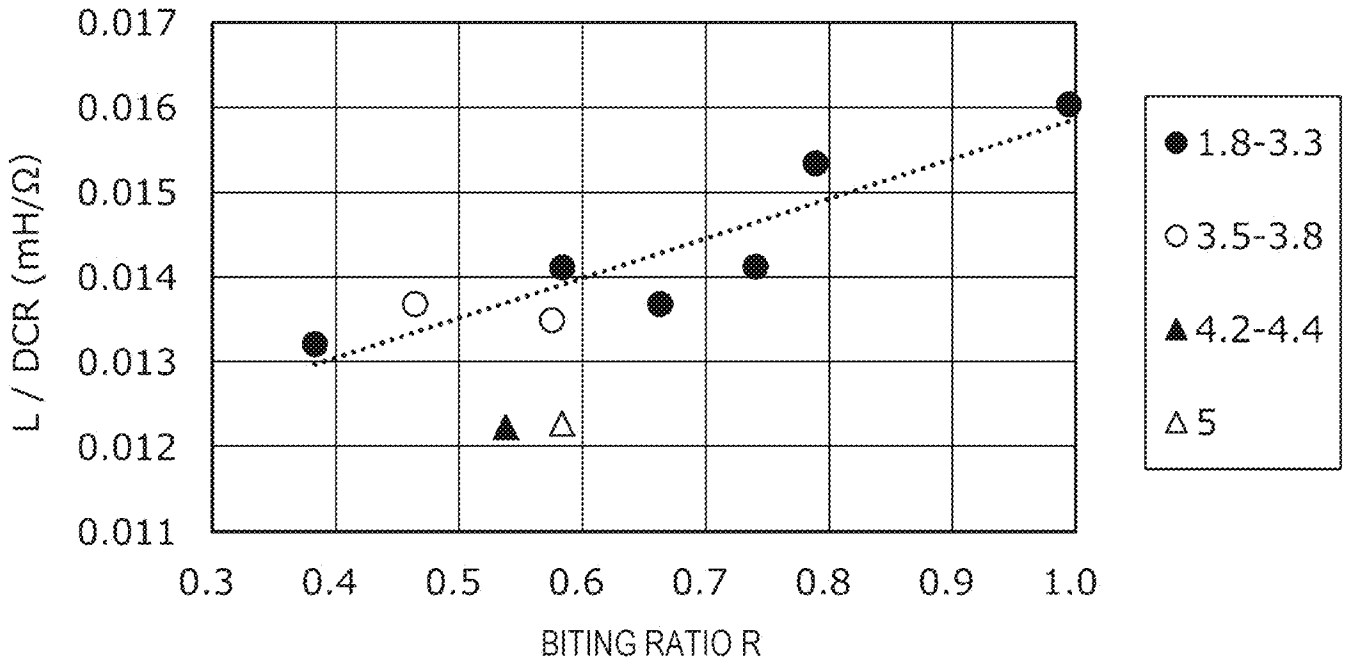
FIG. 13 is a graph showing the relation between L/DCR (unit: mH/Ω) and the biting ratio R.

For each of the inductance elements in other Examples, the same observation, measurement, computation as those in Example 4 were performed. In each of the Examples, the measurement was performed at at least 100 points on the inter-coil insulating coatings 12*i* to determine the average thickness B of the inter-coil insulating coatings 12*i*. In each of the Examples, the number of thin-walled portions having a thickness equal to or less than the average thickness B of the inter-coil insulating coatings 12*i* measured for the computation of the biting depth d was 15 or more. The results are shown in Table 1. FIG. 12 is a graph showing the relation between the withstand voltage (unit: V) of coils and the biting ratio R. FIG. 13 is a graph showing the relation between L/DCR (unit: mH/Ω) and the biting ratio R. The legends of FIGS. 12 and 13 show the average thickness B (unit: μm) of the inter-coil insulating coatings 12*i*. Specifically, "●1.8-3.3" means the results when the average thickness B of the inter-coil insulating coatings 12*i* is within the range of from 1.8 μm to 3.3 inclusive. The same applies to the other symbols ("○," "▲," and "Δ").

The inductance element according to the embodiment of the present invention can be preferably used as components of power source circuits for display units of portable electronic devices such as smartphones and notebook computers.

What is claimed is:

1. An inductance element comprising:

a magnetic core that is a compact containing a magnetic powder; and a coil having an embedded portion embedded in the magnetic core, the embedded portion including:

a wound portion formed by winding a coil wire which includes a wire-shaped conductor and an insulation coating covering a surface of the conductor wherein the insulation coating of the wound portion has a contact region in which portion of the insulation coating is in contact with the magnetic powder, the insulation coating in the contact region including a thin-walled portion having a reduced thickness due to the contact with the magnetic powder, and wherein the thin-walled portion has a biting ratio R from 0.4 to 0.85 inclusive, the biting ratio R being defined by the following formula (I):

$$R=ds/B \quad \text{(I)}$$

where B is an average thickness (unit: μm) of inter-coil insulation coatings which are portions of the insulation coating located between two adjacent parts of the conductor in the wound portion, the average thickness being an arithmetic mean of measured thicknesses obtained by measuring the thickness of the inter-coil insulation coatings at at least 100 points, and ds is a maximum biting amount (unit: μm) expressed by (da+3.99σ), wherein da is a mean of a normal distribution that approximates a frequency distribution of a biting depth d (unit: μm) measured at at least 15 points in the inductance element, the biting depth d being obtained by subtracting the thickness of the thin-walled portion smaller than the average thickness B from the average thickness B, and σ is a standard deviation of the normal distribution.

2. The inductance element according to claim 1, wherein the average thickness B of the inter-coil insulation coatings is from 1 μm to 5 μm inclusive.

3. The inductance element according to claim 1, wherein at least part of the magnetic powder is made of an amorphous alloy material.

4. The inductance element according to claim 1, wherein the magnetic powder has a median diameter D50 of 1 μm to 15 μm inclusive.

5. The inductance element according to claim 1, wherein the insulation coating contains a polyimide-based material.

6. The inductance element according to claim 1, wherein the conductor has a rectangular cross-section, and the wound portion is formed by edgewise winding of the coil wire.

7. The inductance element according to claim 6, wherein the thickness of the thin-walled portions is measured at an end of the wound portion in a direction along a winding center line.

8. The inductance element according to claim 1, wherein the inductance element includes a portion having an embedded depth equal to or less than 0.25 mm, the embedded depth being an amount of the coil wire embedded into the magnetic core in a direction along a winding center line of the wound portion.

* * * * *